US010682023B2

(12) United States Patent
Holden

(10) Patent No.: US 10,682,023 B2
(45) Date of Patent: Jun. 16, 2020

(54) MAGNETIC RESISTANCE FOR ROLLED MATERIAL DISPENSERS

(71) Applicant: William Holden, Durango, CO (US)

(72) Inventor: William Holden, Durango, CO (US)

( * ) Notice: Subject to any disclaimer, the term of this patent is extended or adjusted under 35 U.S.C. 154(b) by 215 days.

(21) Appl. No.: 15/946,676

(22) Filed: Apr. 5, 2018

(65) Prior Publication Data

US 2018/0325335 A1 Nov. 15, 2018

Related U.S. Application Data

(60) Provisional application No. 62/483,922, filed on Apr. 10, 2017.

(51) Int. Cl.

| | |
|---|---|
| ***A47K 10/38*** | (2006.01) |
| ***B65H 16/04*** | (2006.01) |
| ***B65H 16/00*** | (2006.01) |

(52) U.S. Cl.

CPC .. *A47K 10/3836* (2013.01); *A47K 2010/3863* (2013.01); *B65H 16/005* (2013.01); *B65H 16/04* (2013.01); *B65H 2401/213* (2013.01); *B65H 2402/41* (2013.01)

(58) Field of Classification Search

CPC ..... A47K 10/38; A47K 10/3827; A47K 10/3836; A47K 2010/3863; B65H 2402/41; B65H 16/005; B65H 16/04; B65H 2401/213

See application file for complete search history.

(56) References Cited

U.S. PATENT DOCUMENTS

| | | | | | |
|---|---|---|---|---|---|
| 2,610,806 | A * | 9/1952 | Lathrop | B65H 59/00 | 242/415.1 |
| 3,170,652 | A | 2/1965 | Kennedy | | |
| 3,721,394 | A * | 3/1973 | Reiser | B21C 47/34 | 242/421.3 |
| 3,770,221 | A | 11/1973 | Stern | | |
| 4,239,163 | A | 12/1980 | Christian | | |
| 5,967,445 | A * | 10/1999 | Yuyama | B65H 16/04 | 242/421.1 |
| 6,145,771 | A * | 11/2000 | Santa Cruz | A47K 10/38 | 225/106 |
| 6,585,181 | B2 * | 7/2003 | Kronenberger | B65H 75/18 | 242/129.8 |
| 6,883,298 | B2 * | 4/2005 | Gooding | B65B 67/085 | 156/574 |
| 7,124,976 | B1 | 10/2006 | DeVincenzo | | |
| 7,367,520 | B2 | 5/2008 | Neveu | | |
| 7,438,256 | B2 | 10/2008 | Nip et al. | | |
| 9,648,994 | B2 * | 5/2017 | Cattacin | A47K 10/38 | |
| 2016/0198911 | A1 * | 7/2016 | Ruiz | B65H 16/06 | 242/596.7 |

* cited by examiner

*Primary Examiner* — William A. Rivera
(74) *Attorney, Agent, or Firm* — Fox Law Group, LLC

(57) ABSTRACT

The present invention provides a holder and dispenser of rolled products such as paper, plastic, foil, tape and other goods with magnetic resistance. The dispenser generally includes a base and a cage that supports the roll of material and rotates relative to the base. A magnetic resistance mechanism is generally located between the base and the cage. The magnetic resistance mechanism creates forces that act to resist rotation of the cage relative to the base.

9 Claims, 4 Drawing Sheets

MAGNETIC RESISTANCE FOR ROLLED MATERIAL DISPENSERS

FIELD OF THE INVENTION

The present invention relates in general to holders and dispensers of rolled materials, for example materials such as paper, plastic, foil, tape or other goods. In particular, the present invention dispenses a desired amount of material, such as a paper towel without the roll unraveling or providing more material than necessary.

CROSS-REFERENCE TO RELATED APPLICATION

This application claims the benefit of U.S. Provisional Application No. 62/483,922, filed Apr. 10, 2017.

BACKGROUND ART

Household products are often supplied in continuous sheets on roll such as a roll of paper towels. The individual sheets on the roll are often perforated at uniform length to provide tearing of the desired amount of material from the roll. A holder that secures the roll and permits the roll to rotate commonly dispenses product. In many dispensers, the roll may rotate freely making it more difficult to dispense only the desired amount and making it more likely that the roll will unravel when the leading sheet of material is pulled.

Although prior art solutions have used friction to limit the rotation of the dispenser, it is difficult to control and maintain the proper amount of friction to allow the proper dispensing of the desired material, yet limit the unraveling of the roll when the leading sheet is pulled. Therefore, it is desired that there is a need for a holder and dispenser for rolled products that more precisely controls the dispensing of a rolled product while preventing unraveling of the roll when the leading sheet is pulled.

SUMMARY OF THE INVENTION

The present invention is a holder and dispenser for rolled products such as paper, plastic, foil, tape and other goods. The dispenser generally includes a base having and axle extending perpendicular to the base and a cage that supports the roll of material and rotates about the axle. The base may be configured to rest on a surface such as a countertop or be mounted to a wall in a horizontal fashion for dispensing material. The axle supports the cage and permits the cage to rotate relative to the base. The cage is often formed from a plurality of flexible wires that engage the inside of the roll of material such that the roll does not move relative to the cage and thus the roll rotates about the axle. A magnetic resistance mechanism is generally located between the base and the cage. The magnetic resistance mechanism creates forces that act to resist rotation of the cage relative to the axle and base.

The magnetic resistance mechanism generally consists of two magnetic discs. A first magnetic disc is affixed to the cage and is free to rotate with the cage while a second magnetic disc is affixed to base and remains stationary. Each disc is made of magnetic material with areas of alternating north magnetic pole and south magnetic pole on each disc. The areas of north magnetic poles of one disc are attracted to areas of south magnetic pole on the other disc. While rotating the cage about the axle, the magnetic forces between the poles on the stationary disc and the poles on the rotating disc create a resistance force. As the first disc begins to rotate, the forces between the magnetic poles on the stationary disc and the rotating disc act to resist rotation until the roll has rotated to a point where the attractive force of the next set of poles overcome the resistive forces between the last set of poles. The alternating resistive forces and attractive forces of the magnetic poles limit the rotation of the cage relative to the axle and base. The amount of resistance may be varied depending upon the number of magnetic areas, the size of the magnetic areas, the space between each magnetic disc, and or the strength of the magnetic forces in the discs themselves.

The embodiments of the roll holder dispenser will be described reference now to the drawings FIGS. 1-9. While the embodiments described below are intended as an exemplary dispenser, it will be appreciated by those skilled in the art that the present invention is not limited to any particular the arrangement described below and embodiments may be utilized for the dispensing of any rolled material of any width, length or diameter whether the material is segments or continuous.

DETAILED DESCRIPTION OF INVENTION

Figure 1:
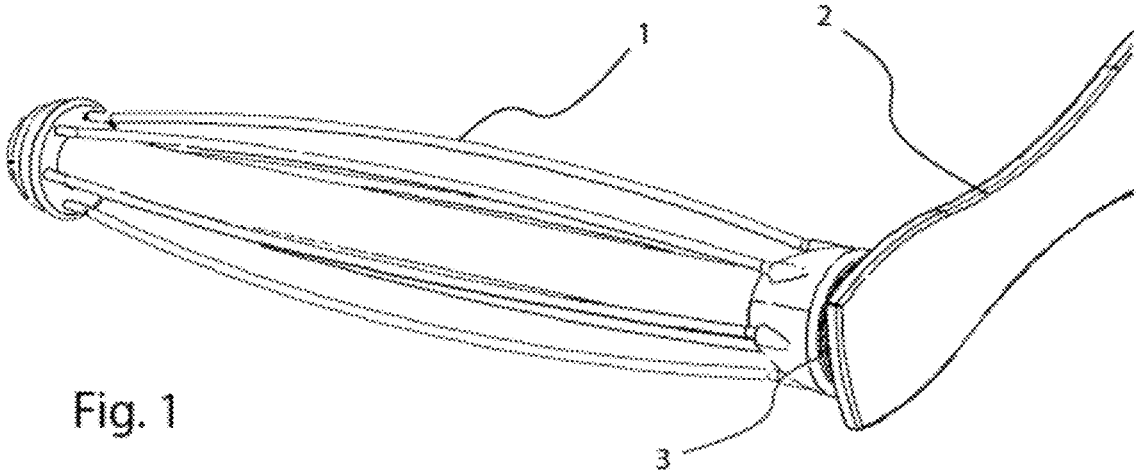
FIG. 1 shows a view of the material dispenser of the present invention with a rotating cage, a base, and two magnetized disks.
Figure 2:
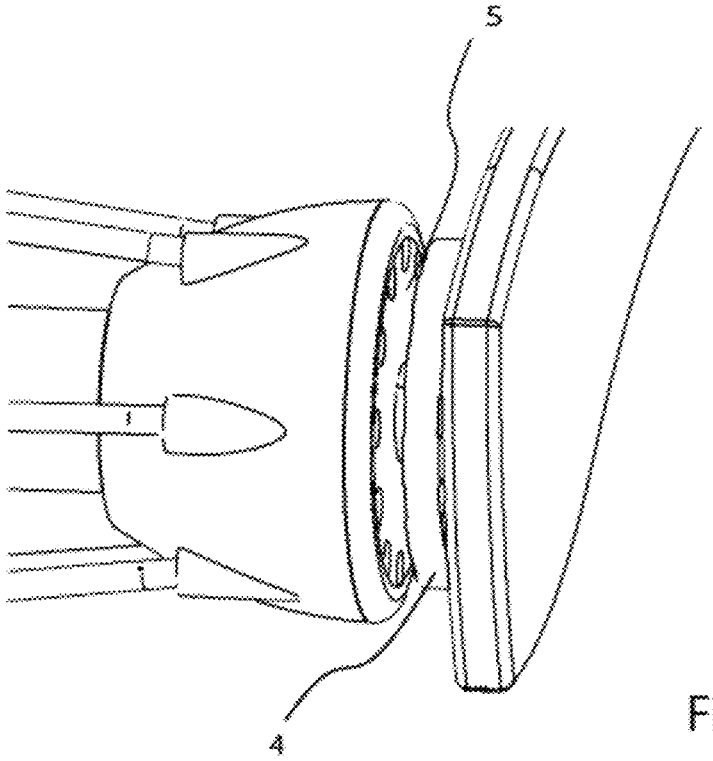
FIG. 2 shows a close-up view of a portion of the material dispenser.
Figure 3A:
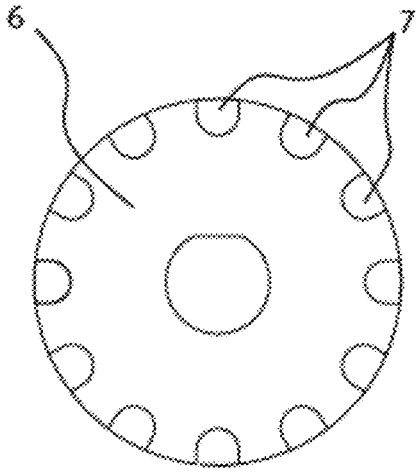
FIG. 3*a* shows a view of a magnetic disk.
Figure 3B:
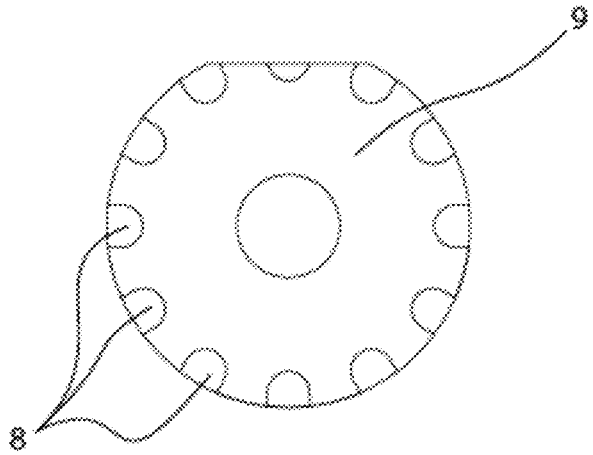
FIG. 3*b* shows a view of a second magnetic disk.
Figure 4:
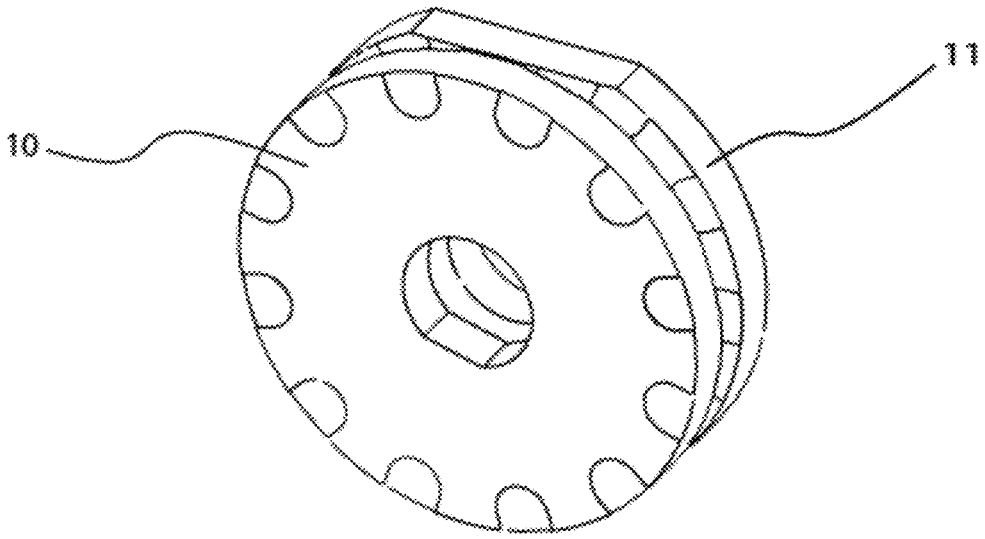
FIG. 4 shows a view of magnetic disks paired together.

Referring now to FIGS. 1-7, a first embodiment of the roll holder and dispenser comprises a base 2 having an axle attached to the base 2, a cage 1 configured to rotate about the axle, and a magnetic resistance mechanism 3 that provides controlled resistance to rotation of the cage 1 about the axle relative to the base 2.

Generally, the magnetic resistance mechanism 3 is comprised of a first network of alternating magnetic north and south polar areas 5 attached to the cage 1 and a second network of alternating magnetic north and south polar areas 4 attached to the base 2 and positioned opposite the first network. As the cage 1 rotates relative to the base 2, the first magnetic network 5 repels the second magnetic network 4 when the polarity of the magnetic area of the first network and polarity of the magnetic area of the second network is the same. The networks will then go through a defined transition point as the first network rotates relative to the second network. As the networks rotate relative to each other the polarity reverses and areas of opposite polarity will attract each other. When the areas are attracted to each other, a resistive force is created because the opposite polarity areas of each network will attempt to stay together. This alternating repulsion and attraction creates resistive torque that resists the cage 1 from rotating relative to the axle and base 2.

In one embodiment, the magnetic resistance mechanism 3 comprises a first magnetic disc 6 and a second magnetic disc 9 that each has areas of alternating magnetic north poles and magnetic south poles 7, 8. The first magnetic disc 6 is fixed to the cage 1 and rotates as the cage 1 rotates. The second magnetic disc 9 is fixed relative to the base 2 and positioned opposite and along the same axis as the first magnetic disc. As the cage 1 is rotated the attractive forces between opposite magnetic poles on the first disc and the second disc create a force that resists rotation until the attractive force of next set of magnetic poles is greater than the resistive force. The areas of north magnetic pole are attached on the rotating disc are attached to the areas of south magnetic pole on the stationary disc, and vice versa. As the disc begins to rotate, the forces between the magnetic poles on the stationary disc and the rotating disc act to resist rotation until the roll has rotated to a point where the attractive force of the next set of opposite poles overcomes the resistive force between the last set of poles as the magnetic connection breaks. This resistance and attraction creates a rotational torque that controls rotation of the cage 1 relative to the axle and base 2. This controlled rotation permits controlled dispensing of the roll of material and prevents the roll from unraveling when the leading edge is pulled.

Figure 8:
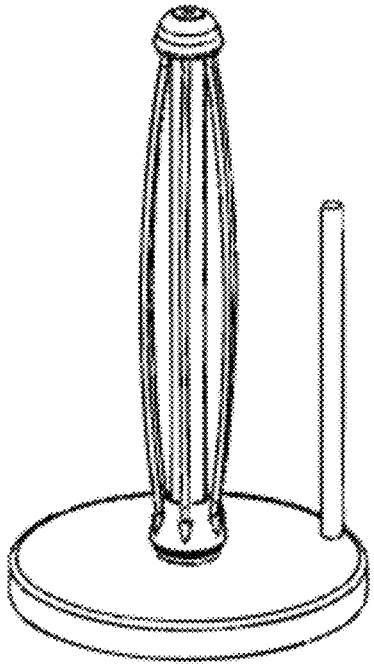
FIG. 8 shows an alternative vertical arrangement of the material dispenser.
Figure 9:
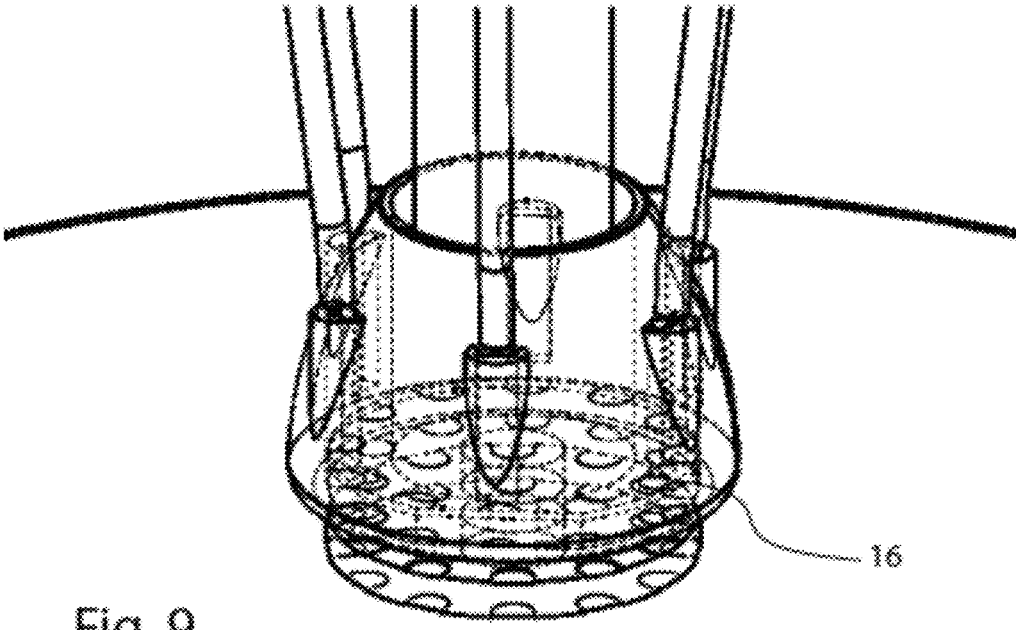
FIG. 9 shows a close-up view of the invention shown in FIG. 8.

In one embodiment, the base 2 comprises an arm that extends away for a wall so that the roll of material is held in a horizontal plane for dispensing. In an alternative embodiment shown in FIGS. 8-9, the base 2 is configured to rest on a flat surface such that the axle extends upwardly.

In an alternative embodiment, the base 2 may also include a tear bar. The tear bar supports the material as it is dispensed from the roll.

The axle extends generally perpendicular from the base 2 and is fixed from rotation to the base 2. It may be removable. In on embodiment the axle is attached to the base 2 via a threaded connection. The axle may also be riveted or adhered to the base 2. In one embodiment, the axle is formed from the same material as the base 2. The axle is made of any material of sufficient strength to support the roll of material to be dispensed. In an embodiment to the present invention, the axle is uniform diameter. In an alternative embodiment, the axle has a first end and a second end that communicates with the cage 1 to permit smooth rotation and a mid-section that is of a reduced diameter.

The cage 1 engages the roll of material to be dispensed such that the roll does not rotate relative to the cage 1. In one embodiment, the cage 1 comprises an end cap, a support cap, and a plurality of flexible wires connecting the end cap to the support cap. The flexible wires have sufficient mechanical properties to engage the inner diameter of the roll of material and prevent slippage between the roll and the flexible wires. In an alternative embodiment, a flexible cylindrical member extends between the end cap and the support cap to engage the inner diameter of the roll and prevent slippage between the cylindrical member and the roll.

The end cap is configured to accept the roll of material as it is placed onto the cage 1. In one embodiment, the end cap is conically shaped to ease engagement of the roll and the cage 1. In an alternative embodiment, the end cap is cylindrical. The end cap secures one end of the plurality of flexible wires or the cylindrical member.

The end cap engages the distal end of the axle. The end cap has an inner diameter generally equal to the diameter of the axle to rotate easily around the axle. In one embodiment, the end cap is free to rotate about the axle but is fixed along the axle such that is cannot move longitudinally along the axle. In another embodiment, the end cap is free to rotate about the axle and free to translate longitudinally along the axle. The end cap may include bearings to reduce rotational friction between the end cap and the axle. This may be desirable when holding and dispensing rolls of heavy materials or larger rolls. The end cap is made from any material sufficient to accept a roll of material and support one end of the roll while the material is being rotated and dispensed.

The support cap is configured to support the proximal end of the roll of material and rotate about the proximal end of the axle. The support cap comprises an outer diameter that holds the inner diameter of the roll of material, an inner diameter that rotates about the proximal end of the axle.

In one embodiment, the plurality of flexible wires connects to the outer diameter of the support cap. In another embodiment, the cylindrical member connects to the out diameter of the support cap.

The support cap may include bearings to reduce rotational friction between the end cap and the axle. This may be desirable when holding and dispensing rolls of heavy materials or larger rolls. The support cap is made from any material sufficient to accept a roll of material and support one end of the roll while the material is being rotated and dispensed.

The rotation of the cage 1 relative to the axle and base 2 is controlled by a magnetic resistance mechanism 3. The magnetic resistance mechanism 3 comprises a first magnetic disc fixed to the cage 1 that rotates with the cage 1 when a portion of the roll of material is dispensed and a second magnetic disc positioned along the same longitudinal axis facing the first disc and fixed stationary to the base 2. The magnetic discs each have a series of magnetic areas positioned such that the face of each magnetic disc has alternating north magnetic poles and south magnetic poles circumferentially located around the disc.

As the cage 1 is rotated, the attractive forces created between magnetic areas of opposite magnetic poles on the rotating magnetic disc affixed to the cage 1 and stationary magnetic disc affixed to the base 2 create a torque that resists rotation of the cage 1 until the attractive force of next set of opposite magnetic poles on each disc is greater than the resistive force of the previous two magnetic areas of the mating discs. The plurality of alternating magnetic poles on each disc creates alternating resistive and attractive forces to control rotation of the cage 1 relative to the axle and base 2. The alternating magnetic forces create a resistance torque to rotating the cage 1 and roll of material. This controlled rotation permits controlled dispensing of the roll of material and prevents the roll from unraveling when the leading edge is pulled.

The first magnetic disc is positioned to rotate with the cage 1 and control rotation of the cage 1 relative to the axle and base 2. In one embodiment, the first magnetic disc is affixed to the support cap of the cage 1 and it rotates around the axle. In an alternative embodiment, the first magnetic disc is formed integral to the support cap.

The second magnetic disc is positioned in a location along the same axis as the first magnetic disc such that the magnetic areas of the second disc communicate with the magnetic areas of the first disc. In one embodiment, the second magnetic disc is fixed to the base 2 and does not rotate relative to the base 2. In an alternative embodiment, the magnetic disc is formed in the base 2. In yet another embodiment, the magnetic disc is placed over the axle and engages the axle in a manner such that it does not rotated relative to the axle and base 2. The magnetic disc may engage the axle with a key slot or other feature that retains the second disc stationary and prevents it from rotating relative to the axle and base 2.

The number of magnetic areas is driven by the amount of resistive torque desired to provide the correct amount of resistance to rotation for a proper tear of a segment from a roll of material. In one embodiment, both discs have ten magnetic areas. In another embodiment, a single magnetic area of north polarity is attached to the cage 1 and a single magnetic area of south polarity is attached to the base 2 creating a magnetic latch that can be broken and then reconnected creating a resistance torque. It will be understood that the magnetic areas of alternating polarity may be arranged on other components such the rotation of the cage 1 relative to the base 2 is controlled. The magnetic discs may be made of any and thickness to provide desired magnetic control of rotation of the cage 1 relative to the axle and base 2. The magnetic areas may also be of a smaller or larger shape or size to provide desired rotational control. In one embodiment the individual magnetic areas are trapezoidal shaped. In another embodiment, the magnetic areas are the shape of a semicircle. The first magnetic disc may have magnetic areas of one shape and the second magnetic disc may have magnetic areas of the same shape or of different shapes.

The magnetic discs and components of the present invention may have other magnetic areas that do not contribute to resisting rotation of the cage 1 relative to the base 2. For example the first magnetic disc may attached to the cage 1 via a magnetic connection. In an alternative embodiment, the axle may be attached to the base 2 via a removable magnetic connection. Magnetic connection may aid in the alignment of the components of the present invention without contributing to the resistive torque created to resist rotation of the cage 1.

Figure 5:
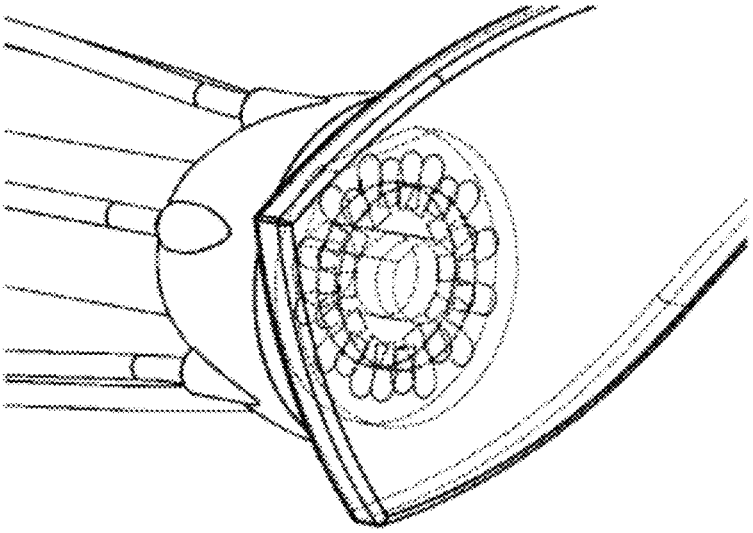
FIG. 5 shows an end-perspective view of the material dispenser.
Figure 6A:
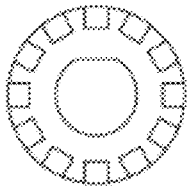
FIG. 6*a* shows alternative view of a magnetic disk.
Figure 6B:
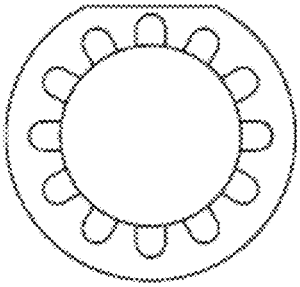
FIG. 6*b* shows alternative view of the matching magnetic disk to the disk shown in FIG. 6*a;*
Figure 7:
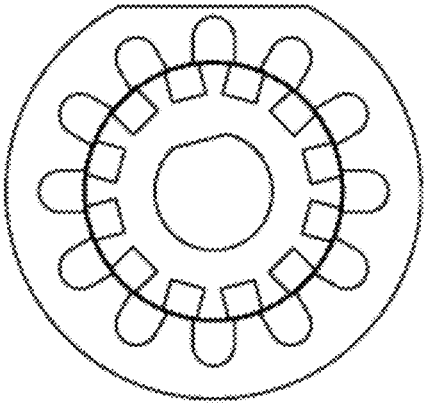
FIG. 7 shows the two magnetized disks of FIG. 6*a* and FIG. 6*b* parts together.

In still another embodiment of the invention as shown in FIGS. 5-7, magnetic areas are located around the inner diameter of the support cap of the cage 1 and around the outer diameter of the axle such that the discs nest. In such an embodiment alternating north and south magnetic poles are positioned around the outer diameter and inner diameters of the discs respectfully such that the alternating opposite poles are attracted to each other and resist free rotation of the cage 1. Nesting can be partial or complete. In yet another embodiment, the magnetic areas are located about the outer diameter of the support cap of the cage 1 and about an inner diameter of an annular disc attached to the axle or base 2. As above, in such an arrangement the magnetic discs would nest or partially nest.

One of skill in the art will recognize that the distance between the first magnetic disc and the second magnetic disc will affect the resistive force as the alternating north magnetic pole is attracted to the corresponding south magnetic pole and so on. In one embodiment, the gap between the first magnet disc and the second magnet disc is fixed. In another embodiment, the gap between the two magnetic discs is variable. In such an embodiment, the gap may be adjusted by rotating a threaded member against one of the discs to move it closer or farther from the other disc. In still another embodiment, the gap between the magnetic discs may be selectable by choosing a different spacer based upon the material to be dispensed or simply the desired resistive torque on the cage 1.

In an alternative embodiment, the magnetic resistance mechanism 3 is not in the form of a disc, but it consists of networks of alternating magnetic north pole and magnetic south pole areas that create a controlled magnetic circuit to create a resistive torque to rotation of the cage 1. For example, a single length of alternating north and south pole magnetic areas along the cage 1 and a single length of alternating north and south pole magnetic areas along the base 2 may resist rotation of the cage 1 until the attractive force of between the opposite pole is broken and the resistive force of the magnetic areas caused by proximity of similar magnetic poles allows movement until the attractive force resists movement again.

The resistive force created by alternating opposite polarity magnetic areas creates a resistive torque on the cage 1 to permit a user to tear a portion of the roll of material without the roll unraveling. The present invention may work with rolls that have perforated sheets at regular intervals or with rolls that are not segregated. It will be appreciated by on of skill in the art that the magnetic disc associated with the rotating cage 1 and the magnetic disc stationary with the axle and base 2 may be arrange in various ways as long as the alternating north magnetic pole of one disc can communicate with the south magnetic pole of the other disc to create an attractive force between the opposite magnetic poles and a resistive torque to rotation of the cage 1 and in turn the roll of material.

The embodiments described are intended as exemplary for a roll holder and dispenser. It will be appreciated by those skilled in the art that the present invention is not limited for dispensing any particular material and may be employed for dispensing products for household use or commercial use.

Although embodiments of the present invention have been shown in the drawings, it will be understood that the invention is not limited to the embodiments disclosed, but is capable of numerous rearrangements, modifications and substitutions without departing from the spirit of the invention as set forth and defined by the claims.

What is claimed is:

1. A dispenser of a roll of material comprising:

a base;

a roll holder rotatably coupled to the base for holding the roll of material; and a base magnetic portion fixedly coupled to the base and a roll holder magnetic portion fixedly coupled to the roll holder, wherein as the roll holder rotates relative to the base, the magnetic forces between the base magnetic portion and the roller holder magnetic portion create a resistance force that intermittently resists rotation of the roll holder as the magnetic portions pass by each other.

2. The dispenser of a roll of material of claim 1, wherein the roll holder has two roll holder magnetic portions.

3. The dispenser of a roll of material of claim 1, wherein the base and the roll holder each have an equal number of magnetic portions.

4. A dispenser of a roll of material comprising:

a base;

a roll holder rotatably coupled to the base for holding the roll of material;

a magnetic resistance mechanism disposed between the roll holder and the base, the magnetic resistance mechanism comprised of a first disk fixedly coupled to the base having a magnetic portion and a second disk fixedly coupled to the roll holder having a magnetic portion such that as the roll holder rotates relative to the base, the magnetic forces between the first disk magnetic portion and the second disk magnetic portion create a resistance force that intermittently resists rotation of the roll holder as the magnetic portions pass by each other.

5. The dispenser of a roll of material of claim 4, wherein the second disk has two magnetic portions.

6. The dispenser of a roll of material of claim 4, wherein the first disk and the second disk have an equal number of magnetic portions.

7. A dispenser of a roll of material comprising:

a base;

a roll holder rotatably coupled to the base for holding the roll of material;

a magnetic resistance mechanism disposed between the roll holder and the base, the magnetic resistance mechanism comprised of disk fixedly coupled to the base having a magnetic portion and a roll holder magnetic portion fixedly coupled to the roll holder, wherein as the roll holder rotates relative to the base, the magnetic forces between the disk magnetic portion and the roll holder magnetic portion create a resistance force that intermittently resists rotation of the roll holder as the magnetic portions pass by each other.

8. The dispenser of a roll of material of claim 7, wherein the roll holder has two roll holder magnetic portions.

9. The dispenser of a roll of material of claim 7, wherein the first disk and the roll holder have an equal number of magnetic portions.

* * * * *